US006044163A

United States Patent [19]

Weinfurtner

[11] Patent Number: 6,044,163

[45] Date of Patent: Mar. 28, 2000

[54] HEARING AID HAVING A DIGITALLY CONSTRUCTED CALCULATING UNIT EMPLOYING A NEURAL STRUCTURE

[75] Inventor: Oliver Weinfurtner, Fishkill, N.Y.

[73] Assignee: Siemens Audiologische Technik GmbH, Erlangen, Germany

[21] Appl. No.: 08/864,066

[22] Filed: May 28, 1997

[30] Foreign Application Priority Data

Jun. 21, 1996 [EP] European Pat. Off. ..... 96110069

[51] Int. Cl.[7] ..... H04R 25/00

[52] U.S. Cl. ..... 381/312; 381/313

[58] Field of Search ..... 381/320, 321, 381/312, 314, 323, 313

[56] References Cited

U.S. PATENT DOCUMENTS

| | | | |
|---|---|---|---|
| 5,426,720 | 6/1995 | Weinfurtner | 395/22 |
| 5,448,644 | 9/1995 | Pfannenmueller et al. | 381/68 |
| 5,469,530 | 11/1995 | Makram-Ebeid . | |
| 5,604,812 | 2/1997 | Meyer | 381/68.2 |
| 5,606,620 | 2/1997 | Weinfurtner | 381/68.2 |
| 5,706,351 | 1/1998 | Weinfurtner | 381/68.2 |
| 5,717,770 | 2/1998 | Weinfurtner | 381/68.2 |
| 5,754,661 | 5/1998 | Weinfurtner | 381/68.2 |

FOREIGN PATENT DOCUMENTS

| | | |
|---|---|---|
| 0 533 193 | 3/1993 | European Pat. Off. . |
| 0 664 516 | 7/1995 | European Pat. Off. . |
| 0 712 261 | 5/1996 | European Pat. Off. . |
| 0 712 262 | 5/1996 | European Pat. Off. . |
| 0 712 263 | 5/1996 | European Pat. Off. . |
| 42 27 826 | 2/1993 | Germany . |

*Primary Examiner*—Paul Loomis
*Assistant Examiner*—Dionne N. Harvey
*Attorney, Agent, or Firm*—Hill & Simpson

[57] ABSTRACT

A hearing aid has an input transducer, an amplifier and transmission circuit, an output transducer and a calculating unit working according to the principle of a neural structure. The calculating unit responds to a tap signal taken at the amplifier and transmission circuit and units an event signal that is supplied to the amplifier and transmission circuit and influences an output signal emitted thereby. At least the calculating unit is implemented in digital circuit technology. Such a hearing aid can be manufactured with little development and circuit outlay, works reliably and enables an optimum matching to the specific requirements of the hearing aid user.

17 Claims, 7 Drawing Sheets

FIG 1
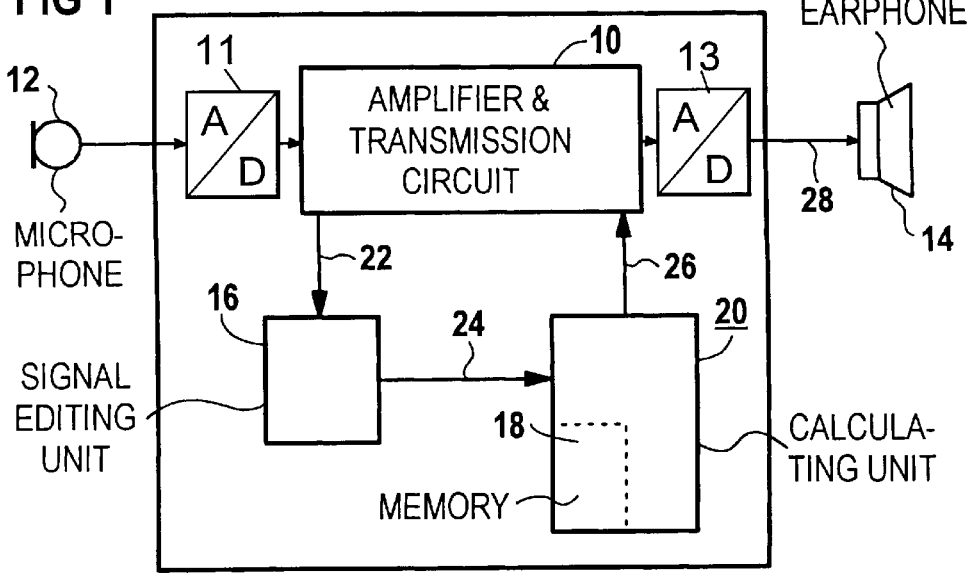
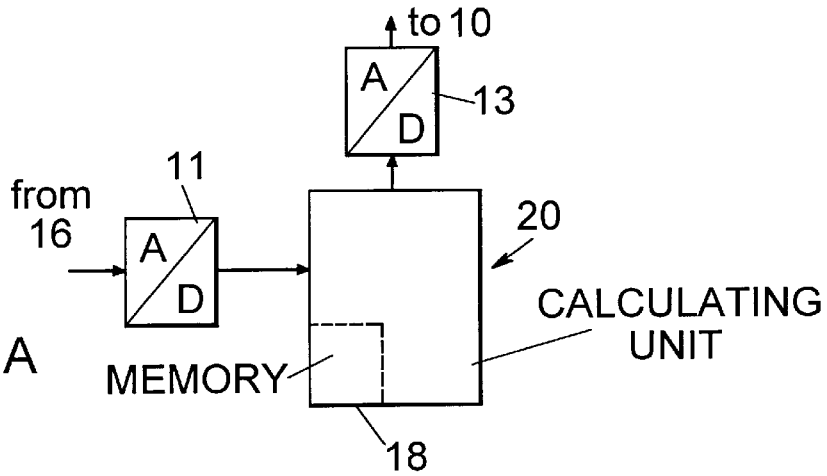
FIG. 1A
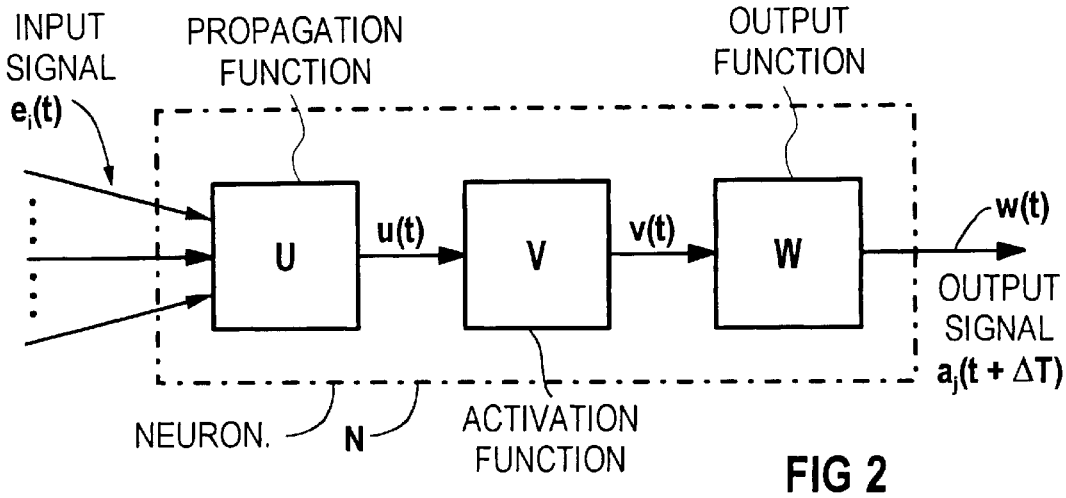
FIG 2

HEARING AID HAVING A DIGITALLY CONSTRUCTED CALCULATING UNIT EMPLOYING A NEURAL STRUCTURE

BACKGROUND OF THE INVENTION

1. Field of the Invention

The present invention is directed to a hearing aid of the type having a calculation unit, employing a neural structure, in order to generate control signals for controlling an amplifier and transmission stage, connected between an input and an output of the hearing aid, for modifying an input signal.

As used herein "signal" means the curve of one or more physical quantities and one or more measuring points over time; each signal can thus be composed of a bundle of individual signals.

2. Description of the Prior Art

European Application 0 712 263 discloses such a hearing aid of the above type wherein a neural structure is utilized in order to either modify the signal transmission characteristic of an amplifier and transmission means or to select a set of parameters from a parameter memory that influence the signal transmission characteristic.

European Application 0 712 261, corresponding to co-pending U. S. application Ser. No. 08/515,907, filed Aug. 16, 1995, discloses a similar hearing aid wherein, however, the signal path is conducted through the neural structure, so that the signals transmitted from at least one microphone to an earphone can be directly processed by the neural structure.

European Application 0 712 262 discloses a hearing aid wherein an automatic gain control (AGC) circuit has a controller based on the principle of a neural structure allocated to it.

The hearing aids disclosed in these published applications, however, only provide that the neural structure be realized in analog circuit technology. Deriving therefrom is the problem of a high circuit-oriented outlay that has a disadvantageous influence particularly because of the miniaturization required in hearing aids.

SUMMARY OF THE INVENTION

An object of the present invention, is to provide a hearing aid which solves the aforementioned problem. In particular, the invention should offer a hearing aid that can be manufactured with little development and circuit outlay and that thereby enables an optimum matching to the specific requirements of the hearing aid user.

This object is inventively achieved in a hearing aid of the above type wherein at least the calculating unit is executed in digital circuit technology. A digital realization of a calculating unit that works according to the principle of a neural structure offers a high degree of compatibility with the digital signal processing: an additional conversion (analog-to-digital or a digital-to-analog) is not required and the calculation unit can be entirely or partially realized with the same components as the remaining processing of the signals. An easy combination of the calculating unit with traditional digital data and signal processing functions as are standard, for example, in microprocessors or signal processors derives therefrom. Moreover, digital technology offers advantages such as increased resistance to interference and insensitivity to manufacturing tolerances. The controlled adaptation (training) of configuration parameters of the calculation unit during on-going operation of the hearing aid is facilitated or even enabled for the first time as a result of the digital realization. The calculating unit is preferably formed with standard digital components such as gates, flip-flops, memories, etc.; more generally with combinational logic systems and sequential logic systems. In particular, it can be fashioned as an ASIC (application specific integrated circuit). Alternatively, it is possible to fashion the calculating unit as a microprocessor or microcontroller with an appertaining program that is stored in a read-only memory (ROM), particularly a mask-programed ROM, PROM, EPROM or EEPROM or with a random access memory (RAM). Mixed forms are also possible; for example, specific, hard-wired modules can be connected to a program control. This is particularly meaningful for functions that are implemented often and that can be digitally realized in a relatively simple way. The calculating unit in the inventive hearing aid is preferably utilized for direct signal processing and/or for the control of signal processing functions and/or for the automatic selection of auditory programs in the hearing aid.

The calculating unit preferably includes means with which the configuration parameters can be influenced, equivalent to training the neural structure simulated by the calculating unit. The training preferably ensues during the on-going operation of the hearing aid. A particularly exact matching to the specific requirements of the hearing aid user is thus possible.

DESCRIPTION OF THE DRAWINGS

FIG. 1A is a block diagram of a portion of the hearing aid of FIG. 1, showing a modified version.

FIG. 1 is a block circuit diagram of an inventive hearing aid.

FIG. 2 is a conceptual illustration of a single neuron in the inventive hearing aid.

DESCRIPTION OF THE PREFERRED EMBODIMENTS

Figure 3A:
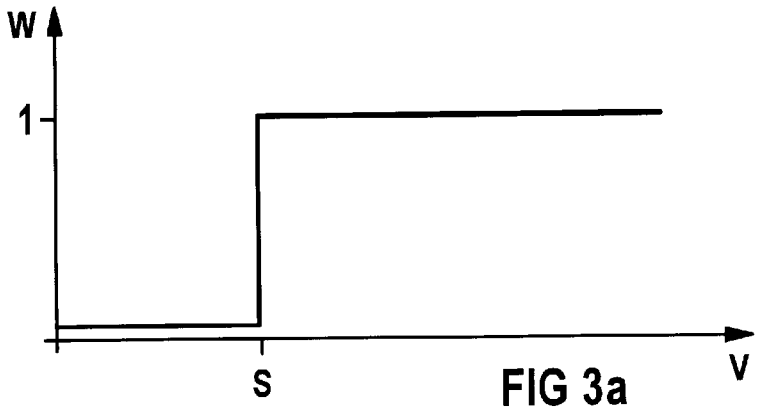
FIGS. 3*a*, 3*b* and 3*c* show examples of possible threshold curves for the output function W shown in FIG. 2 in the inventive hearing aid.

In the hearing aid schematically shown in FIG. 1, a microphone acting as an input transducer 12 converts an acoustical signal into an electrical signal and conducts the electrical signal to an amplifier and transmission circuit 10. The amplifier and transmission circuit 10 amplifies the incoming signal and processes it, for example, by selective boosting or attenuation of specific frequency or volume ranges. An output signal 28 processed in this way is emitted by an earphone serving as an output transducer 14.

A tap signal 22 is taken from the signal path of the hearing aid at at least one suitable location of the amplifier and transmission circuit 10 and is supplied to a signal editing unit 16. The tap signal 22 can also be formed by individual signals that derive from other input transducers, from control elements or from sensors for monitoring systems properties (for example the battery voltage). The signal editing unit 16 suitably edits the tap signal 22, for example by rectification, by averaging or time differentiation, in order to supply it as an input signal 24 to a calculating unit 20 that assumes the function of a neural structure. The teachings of European Application 0 712 263 and it s counterpart U.S. application Ser. No. 08/515,907 filed Aug. 16, 1995 are incorporated herein by reference, and describe the fashioning of the signal editing unit 16 as well as describing the individual signals which compose the tap signal 22.

The calculating unit 20 contains a memory 18 that stores intermediate results, weighting factors of the neural structure realized by the calculating unit 20 and/or parameters that define the network structure of the neural structure. The calculating unit 20 processes the input signal 24 supplied to it in the way described in greater detail below according to the principle of a neural network an emits the result as a result signal 26 to the amplifier and transmission circuit 10, whose amplification and transmission properties can be varied within broad limits by the event signal 26 acting as a control signal.

In the embodiment of the invention shown in FIG. 1A, only the calculating unit 20 is digitally executed, whereas the other assemblies—except for analog-to-digital and digital-to-analog converters that may be required—are formed as analog circuits. In the embodiment of FIG. 1, however, the amplifier and transmission circuit 10, the signal editing unit 16 and the calculating unit 20 are implemented substantially digitally and the tap signal 22, the input signal 24 and the event signal 26 are digital signals that are preferably transmitted in parallel on a number of lines as successive binary numbers. In this alternative embodiment, only the amplifier and transmission circuit 10 includes or is connected to, an analog-to-digital converter 11 for the signal derived from the input transducer 12, and a digital-to-analog converter 13 that generates the output signal 28 conducted to the output transducer 14.

In the embodiment of the inventive hearing aid shown in FIG. 1, the event signal 26 directly controls the transmission characteristic of the amplifier and transmission circuit 10 by setting individual parameters of the amplifier and transmission means 10, for example the gain of specific frequency bands or response and decay times of an automatic gain control (AGC).

In an alternative embodiment, the amplifier and transmission circuit 10 has a memory that contains a number of pre-set or programmed-in parameter sets. A parameter set of this memory is selected based on the event signal 26, for example by the digital event signal 26 serving as a memory address signal.

In another alternative embodiment, the amplifier and transmission circuit 10 does not have a direct signal path from the input transducer 12 to the output transducer 14. Instead, the signal path proceeds from the input transducer 12 over a first part of the amplifier and transmission circuit 10 to the signal editing unit 16, to the calculating unit 20, to a second part of the amplifier and transmission circuit 10 as the event signal 26, and from the latter to the output transducer 14 as the output signal 28. In the second part of the amplifier and transmission circuit 10, the digital event signal 26 is merely converted into an analog signal and filtered as warranted.

The fundamentals of neural structures summarized briefly below have already been presented in detail in European Patent Application European Application 0 712 263 the teachings of which are incorporated herein by reference.

Neural structures are composed of many identical elements that are called neurons. A block circuit diagram of an individual neuron N of this type is shown in FIG. 2. The neuron N generates an output signal $a_j$ (t+Δt) at time t+Δt from a number of input signals $e_j$ (t) at time t. The function of the neuron N can be resolved into the following three basic functions:

Propagation function U: $u(t)=\Sigma e_i(t) * g_i$

The output quantity of this function is the sum of all input signals $e_i$ multiplied with a respectively allocated weighting factor $g_i$.

Activation function V: $v(t+\Delta t)=f(v)t, u(t), u(t))$

The activation function defines the new activation condition v(t+Δt) dependent on the current activation condition v(t) and on u(t).

Output function W: w(t)

The output function usually undertakes a threshold formation. Standard examples are:

Skip function with limitation to a minimum and to a maximum output value; shown in FIG. 3*a*.

Figure 3B:
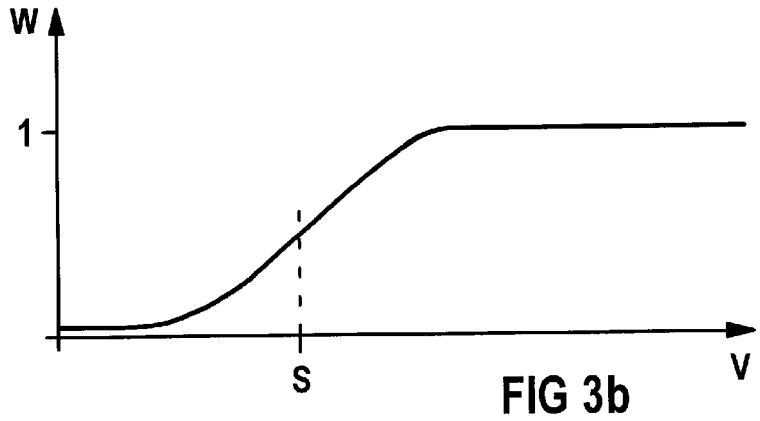
Figure 3C:
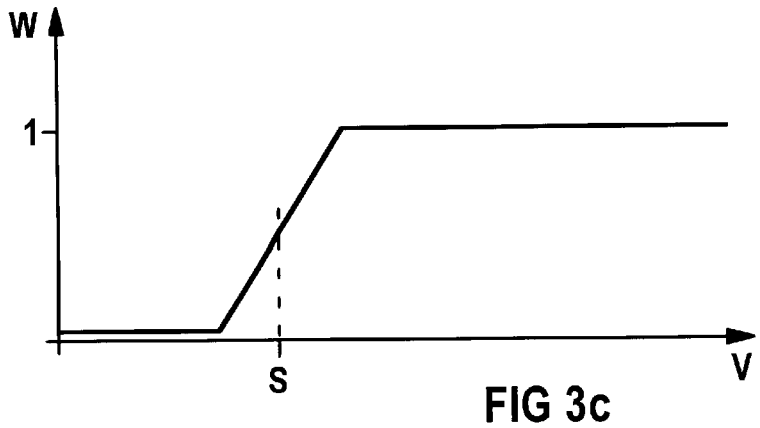

Steady course of the output quantity with limitation to a minimum and a maximum output value. The sigmoid $w(t)=1/(1+e^{-(v(t)-s)})$ is shown in FIG. 3*b* and a linear curve in the transition region is shown in FIG. 3*c*.

Instead of a threshold formation, a linear output function W is often available in the output layer of a neural structure. This allows the generation of continuous output values with the neural structure.

Figure 4:
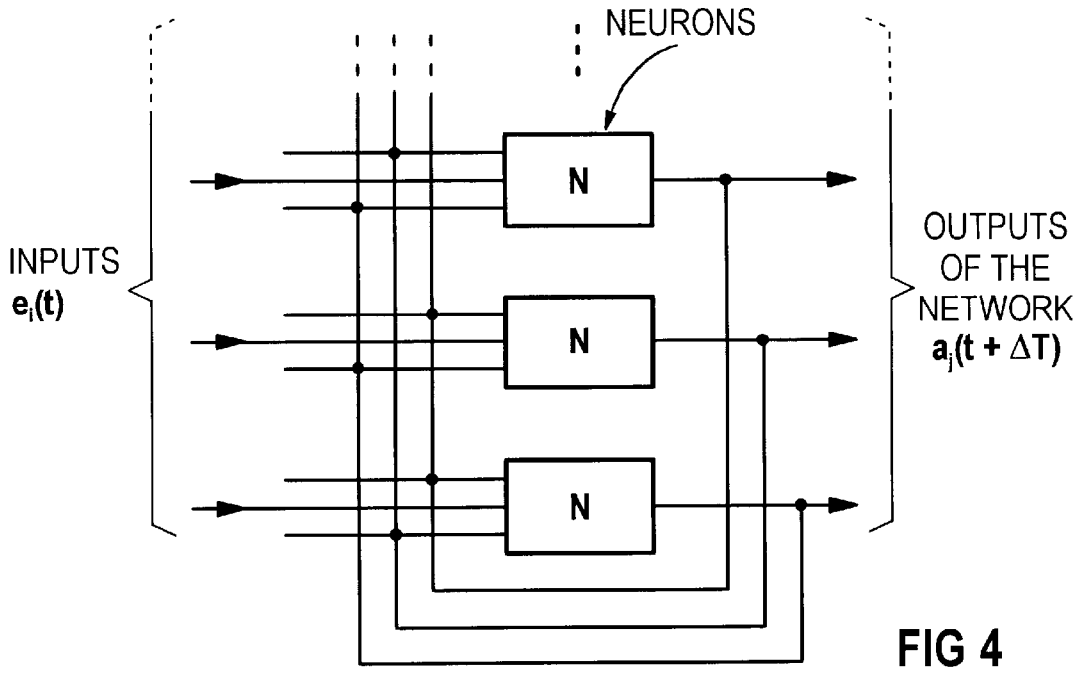
FIGS. 4, 5 and 6 respectively show conceptual presentations of three neural networks in the inventive hearing aid.
Figure 5:
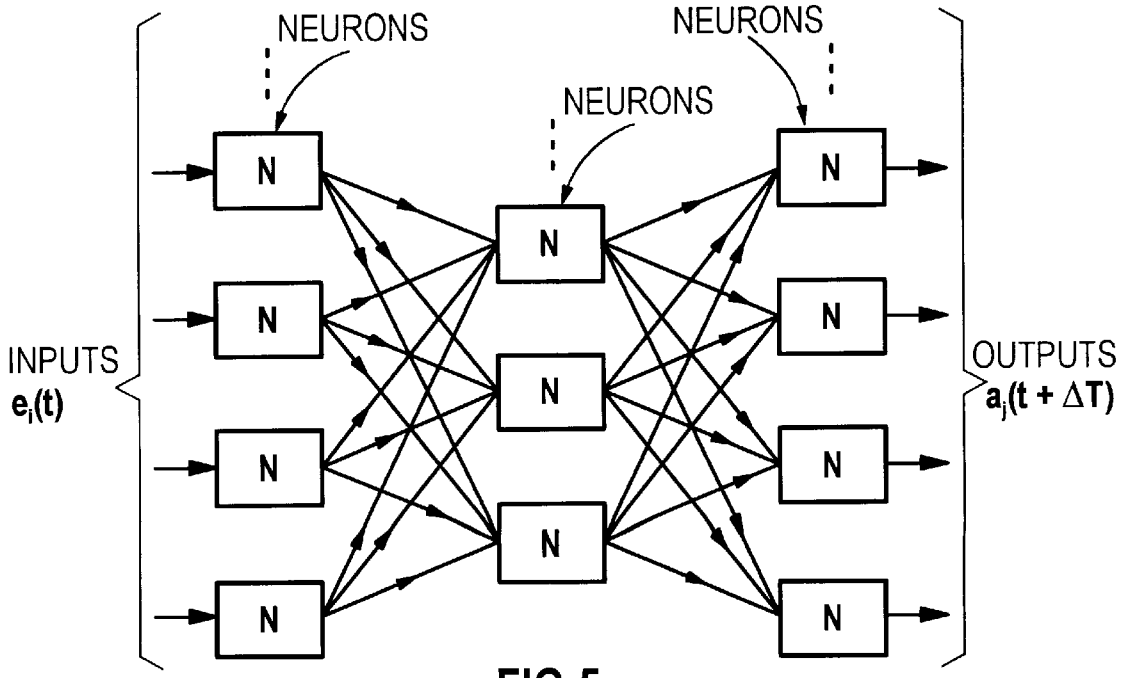
Figure 6:
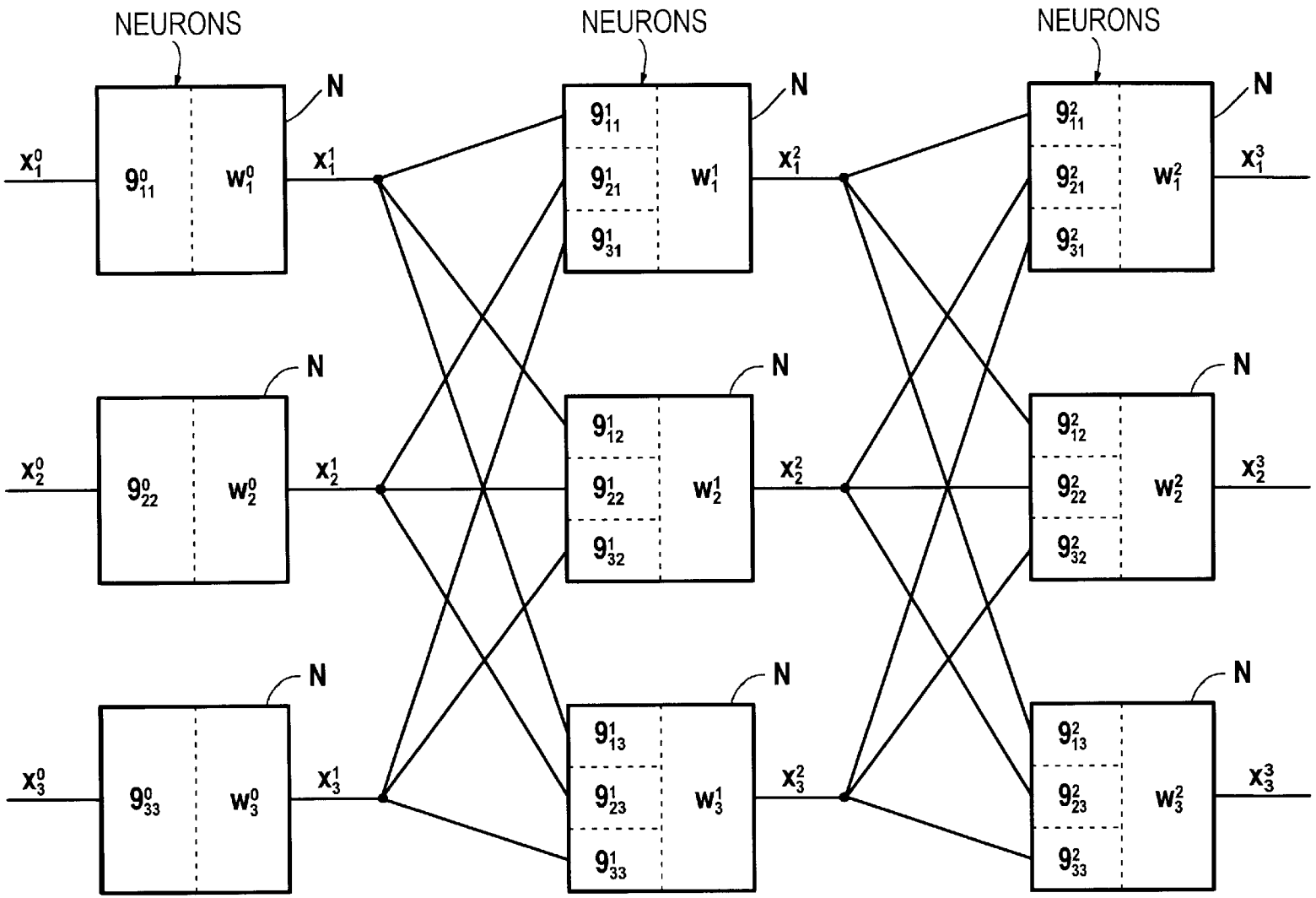

As examples of the interconnection of the neurons 30, FIG. 4 shows a single-layer, feedback network with three neurons N; FIG. 5 shows a multi-layer feedback-free network with 11 neurons N in three layers; and FIG. 6 shows a multi-layer feedback-free network with 9 neurons N in three layers each in a typical interconnection. The network structure employed is dependent on the function to be implemented. Mixed forms a of a number of network structures are also possible. In the inventive, digital realization of the calculating unit 20, the neural network structures shown in FIG. 4 through FIG. 6 merely serve the purpose of conceptual presentation because, given the actual implementation of the calculating unit 20, the functions of a number of neurons N (for example, all neurons N of a layer or even all neurons N of a network) are preferably assumed by a single calculating module of the calculating unit 20.

Figure 7:
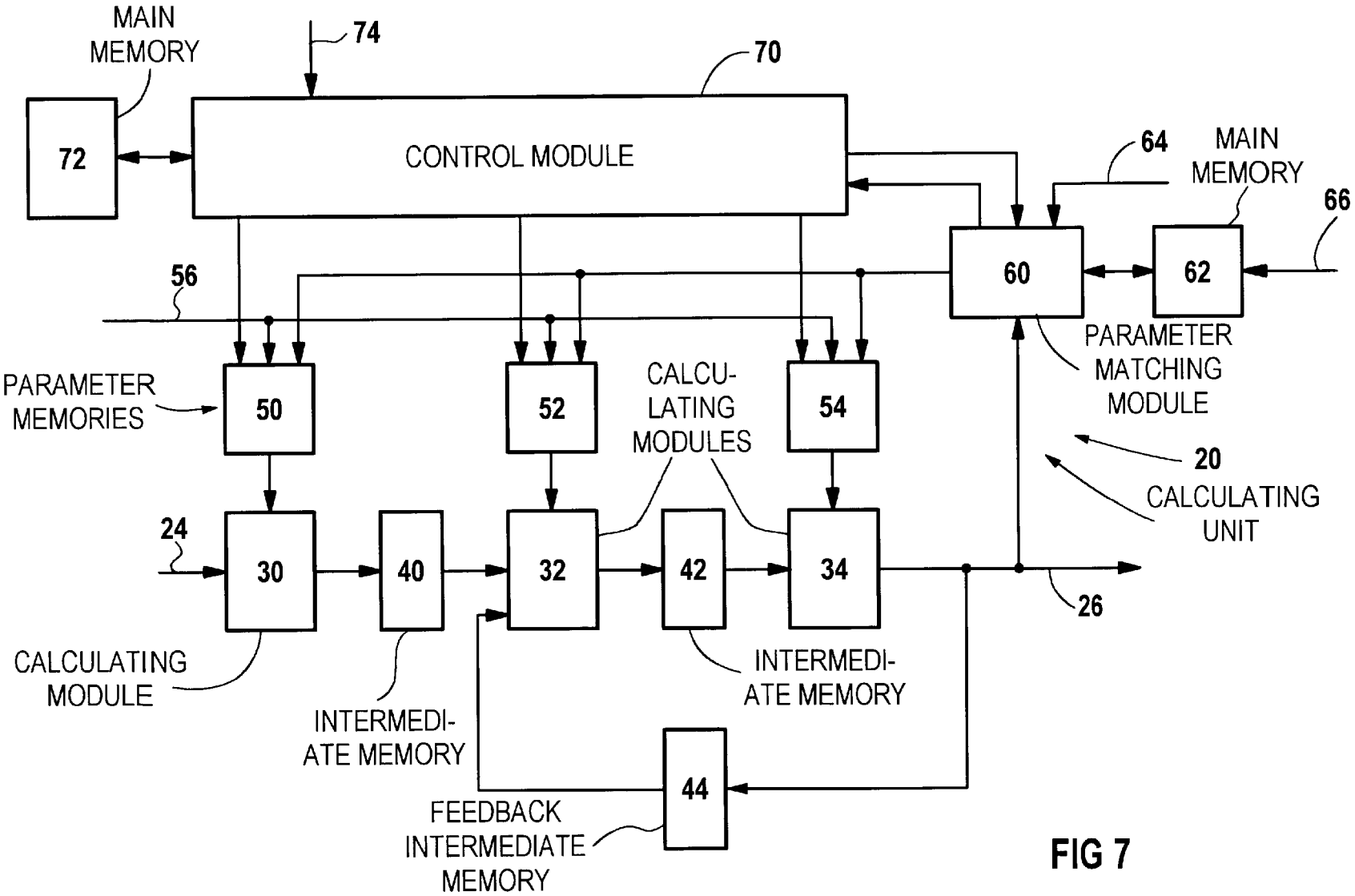
FIG. 7 is a block circuit diagram of a calculating unit of an inventive hearing aid.

FIG. 7 shows a first embodiment of the inventive calculating unit 20 that implements the described functions of a neural structure. Each layer of neurons according to FIG. 4 through FIG. 6 corresponds to one of three calculating modules 30, 32 and 34. The first calculating module 30 receives the input values of the neural structure via the input signal 24; the third calculating module 34 emits the calculated results value as the result signal 26. Intermediate memories 40 and 42 are arranged between the calculating modules 30, 32 and 34, the intermediate results being forwarded via said intermediate memories from one to the next calculating module 30, 32 and 34. The events of the third calculating module 34 are fed back via a feedback intermediate memory 44 to the input of the second calculating module 32, if permitted by the neural structure on which the calculating unit 20.

Respective parameter memories 50, 52 and 54 allocated to each of the calculating modules 30, 32 and 34. Internal intermediate results of the calculating modules 30, 32 or 34 can be stored in these memories, which also contain configuration parameters for the sub-function realized by the allocated calculating module 30, 32 or 34. In particular, these parameters are the weighting factors $g_i$ of the neurons N and the characteristic quantities or characteristics for the further signal processing in the neurons N. It is also possible to describe the networking structure of the excerpt of the neural structure realized by the calculating modules 30, 32 or 34 using modifiable configurations parameters. For configuration of the neural structure, the parameter memories 50, 52 or 54 can be defined with external configuration parameters via a parameter input 56.

A parameter matching module 60 is supplied with the event signal 26 and is connected to the parameter memories 50, 52 and 54. A main memory 62 that can be defined via an external input 66 is allocated to the parameter matching module 60.

The parameter matching module 60 contains the actual learning function of the neural structure. According, for example, to the algorithm described below, it determines adapted configuration parameters and writes these into the parameter memories 50, 52 and 54. The training event can ensue during the on-going operation of the hearing aid, or only during an initial matching and optimization phase, or only in the development of the hearing aid by the manufacturer. In the two latter instances, the parameter matching module 60 in the hearing aid worn by the ultimate consumer can be eliminated or deactivated. The identified configuration parameters are then stored permanently in the hearing aid; for example, they are programmed into the parameter memories 50, 52 and 54, fashioned as EEPROMs, via the parameter input 56.

Two types of training are fundamentally distinguished, namely non-supervised training and supervised training. Non-supervised training occurs according to a predetermined matrix only upon evaluation of the event signal 26 of the neural structure realized by the calculating unit 20. For example, the neural structure can be trained to generate event signals 26 lying as far apart as possible for different auditory situations in order to separate the auditory situations from one another.

In supervised training, the parameter matching module 60 evaluates a desired target reply in addition to the event signal 26, this desired target reply being applied directly to the parameter matching module 60 via a target reply input 64; the parameter matching module 60 also evaluates control signals of the control module 70. This evaluation ensues, for example, according to the algorithm described below. The desired target replies are determined during the training process. For example, they can be entered via an external auxiliary means by the hearing aid user during an initial optimization phase. The hearing aid user thereby preferably selects the desired target reply the user considers optimum from among a number of predetermined test target replies that are respectfully supplied directly to the amplifier and transmission circuit 10 via a suitable switch means instead of the event signal 26.

The predetermined, possible target replies are preferably grouped according to auditory situations, so that the user first indicates the current auditory situation ("in the car", "at work", etc.) and then has a selection among, for example, four test target replies that the hearing aid audiologist predetermined for this auditory situation. The control signal supplied to the amplifier and transmission means 10 is defined exclusively from the desired target reply selected by the user at the start of the optimization phase. With increasing training success, the event signal 26 generated by the calculating unit 20 is added into an increasingly greater extent until, after the end of training phase, the amplifier and transmission circuit 10 is finally controlled only by the calculating unit 20.

A control module 70 of the calculating unit 20 coordinates the overall execution and the collaboration of the calculating modules 30, 32 and 34. For example, the processing time in the calculating modules 30, 32 and 34 can differ dependent on the complexity and number of calculations to be implemented. It is then the task of the control module 70 to inform each calculating modules 30, 32 and 34 when the intermediate results of the preceding calculating module s30, 32 and 34 are available for further processing.

Further, the control module 70 controls the training process of the neural structure in that, for example, it evaluates external request signals at the request input 74 and forwards corresponding control signals to the parameter matching module 70. The switching between different sets of configuration parameters is also initiated by the control module 70 by interpreting the external request signals, and control signals are emitted to the parameter memories 50, 52 and 54. A main memory 72 in which intermediate results and configuration information are stored is allocated to the control module 70.

The realization of the calculating modules 30, 32 and 34 as well as the other components of the calculating unit 20 in digital circuit technology is undertaking using known techniques from the description of the corresponding sub-functions. This can be accomplished using combinational logic systems, sequential logic systems or a combination of the two. Its exact function can be determined by configuration information.

Figure 8:
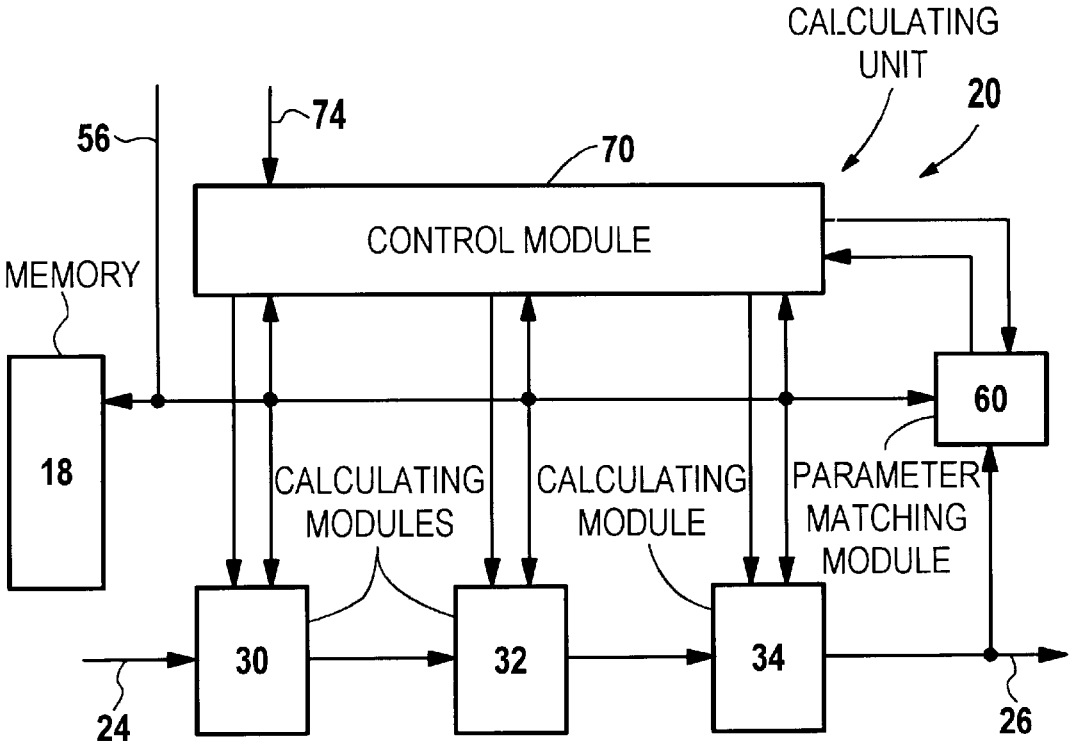
FIG. 8 is a block circuit diagram of a first alternative embodiment of the calculating unit shown in FIG. 7.

FIG. 8 shows a modification of the embodiment of the calculating unit 20. All memory units 40, 42, 44, 50, 52, 54, 62 and 72 shown in FIG. 7 are combined here in the single memory 18. This allows a more rational employment of the memory capacity since it can be arbitrarily partitioned and allocated to the individual modules of the calculating unit 20 as needed. Information required by various modules also need be stored only once in the memory 18.

Figure 9:
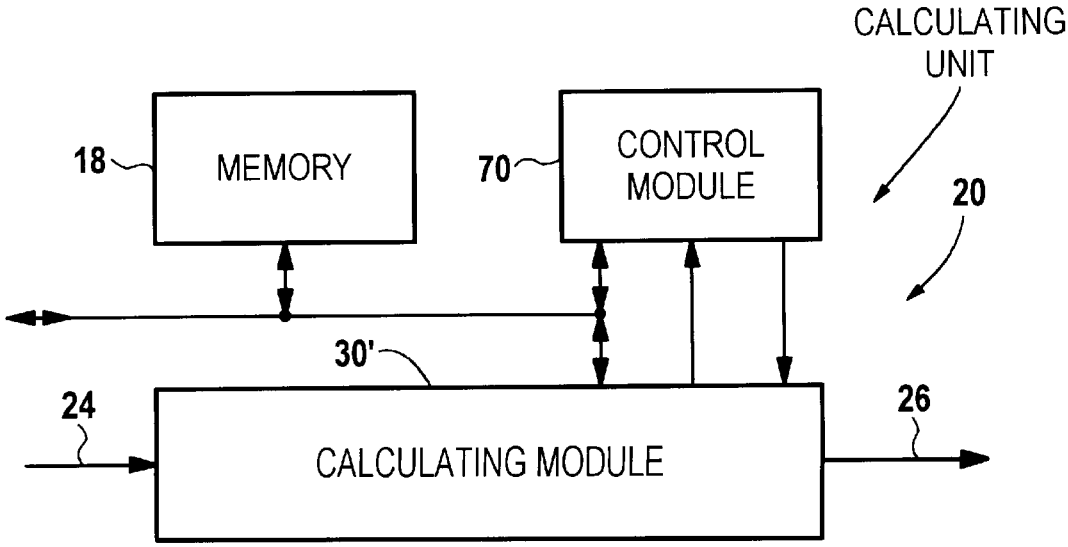
FIG. 9 is a block circuit diagram of a second alternative embodiment of the calculating unit shown in FIG. 7.

FIG. 9 shows a further modified embodiment of the calculating unit 20. All calculating modules 30, 32 and 34 are combined here to form a single calculating module 30'. If this calculating mode 30'is additionally designed as a programmable operational unit insofar as possible, then its calculating capacity can be arbitrarily partitioned and allocated to the individual sub-functions. This assures an optimum data throughput through the overall system.

Figure 10:
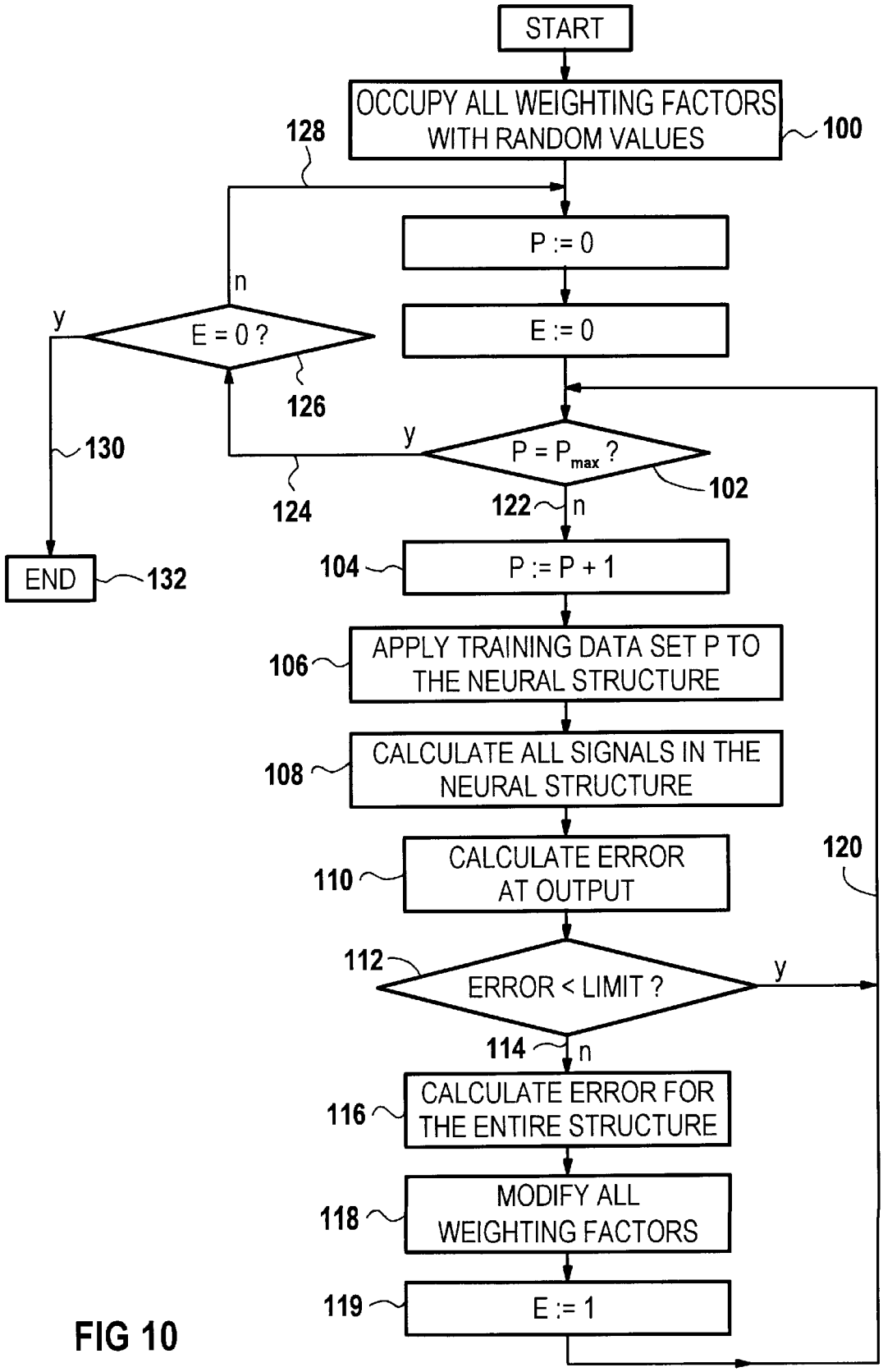
FIG. 10 is a flow chart of an algorithm for training the function of the neural structure in the calculating unit.

An algorithm utilized in an embodiment of the inventive hearing aid for training the neural structure modeled by the calculating unit 20 is shown as a flow chart in FIG. 10. The algorithm works by optimizing adaptation of the configuration parameters (essentially, the weighting factors $g_i$ of the input signals of the neurons N) to the signals to be processed. To this end, sets of training input data are applied to the neural structure and the generated output data of the structure are respectively compared to the desired, ideal output data (also referred to as target replies). From the deviation between these two data sets, information are required in every step as to how the weighting factor $g_i$ are to be modified. At the end of the training phase, the neural structure has then "learned" the desired behavior, i.e. the generated output data are adequately similar to the target replies. When the training of the hearing aid occurs during on-going operation, the training data can correspond to the input signal 24 and, as already described, the target replies can be entered by the hearing aid user.

The designations employed below proceed from FIG. 6. These are:

$x^k_i$: The output signal of the $i^{th}$ of the $k^{th}$ layer $g^k_{ij}$: The weighing factor between the output signal of the $i^{th}$ neuron and the $k^{th}$ layer and the $j^{th}$ neuron of the $(k+1)^{th}$ layer.

$W^k_i$: The output function of the $i^{th}$ neuron of the $(k+1)^{th}$ layer.

In this example, v(t)=u(t) applies to the activation function V for all neurons. Sets of training data are required for the training of the structure, these being respectively composed of the input signals of all input neurons and the appertaining, desired output signals of the output neurons.

The training occurs according to the following rule shown in FIG. 10:

1) Occupy (Step 100) all weighting factors with random values.
2) Apply (Step 106) the input data of the next (Step 104) training data set to the structure and calculate (Step 108) all signals, particularly all output signals, of the entire structure.
3) Calculate (Step 110) the error at the output of the neural structure by comparing the calculated output signals to the desired output data belonging to the current training data set.
4) Where the error is still too big (Test 112, Path 114), then calculate (Step 116) the error at the output of each and every neuron N in the entire structure, and
5) Modify (Step 118) the weighting factors of all neurons N and proceed to the 2) (Path 120) for processing the remaining training data sets, whereby it is noted (Step 119) that a further training path is required.
6) When the error in 4) is small enough (Test 112, Path 120), then check (Test 102) whether this applies to all training data sets.
7) When 6) is still not valid for all training data sets (Path 122) then proceed to 2), otherwise (Path 124) either a further training path is started (Test 126, Path 128) or the training process is terminated (Test 126, Path 130, Step 132).

The flow chart shown in FIG. 10 illustrates an implementation possibility of the training rules that were just described, whereby the program flow is controlled with a Boolean variable E and a counter P serving as an index for the training data sets. The quantity $P_{max}$ stands for the number of predetermined training data sets. The logical execution of this training rule can also be differently implemented, for example by means of structured programming.

The calculating rules described below are preferably employed for the network structure shown in FIG. 6 for the functions recited in the training algorithm in Sections 2), 3) and 4):

Section 2)—calculation (Step 108) of all signals in the neural structure: According to the network structure shown in FIG. 6 and the structure of the individual neuron N of FIG. 2, the output signals—beginning with the input layer—of each and ever neuron N in the entire structure are calculated.

Section 3)—Calculation (Step 110) of the error at the output of the neural structure:

The error at the output of the entire neural structure can be calculated as:

$$E = \sum_j (e^3_j)^2 = \sum_j (d^3_j - x^3_j)^2$$

wherein:

$e^3_j$: The error at the output of the $j^{th}$ neuron N of the third layer (in this case, thus, of the output layer).

$d^3_j$: The value to be expected at the output of the $j^{th}$ neuron N of the third layer according to the training data set (in this case, thus, of the output layer).

$X^3_j$: The value calculated for the output of the $j^{th}$ neuron N of the third layer (in this case, thus, of the output layer).

The square of the difference between the anticipated and calculated value is thus determined for all neurons N of the output layer. The sum of these error squares yields a quantity criterion for the training degree ("convergency degree") of the neural structure.

Section 4)—Calculation (Step 116) of all individual errors in the neural structure:

It is necessary for the modification of the weighting factors to define an error criterion for each and every individual neuron N in the structure from the overall error identified at the output. This occurs by back-calculation of the output error through the entire structure up to the input layer according to the following rule:

$$e^k_j = \left(\sum_j (e^{k-1}_j * g^{k-1}_{ij})\right) * w^{k-1}_i(u^{k-1}_i)$$

wherein:

$e^k_j$: The error at the output of the $j^{th}$ neuron N of the $k^{th}$ layer.

$g^{k-1}_{ij}$: The weighting factor of the connection between the ith neuron N of the $(k-1)^{th}$ layer and the $j^{th}$ neuron of the $k^{th}$ layer.

$w^{k-1}_i(u^{k-1}_i)$: The value of the output function W of the $i^{th}$ neuron N of the $k^{th}$ layer at the location $u^{k-1}_i$.

$u^{k-1}_i$: The value of the propagation function U of the $i^{th}$ neuron N of the $k^{th}$ layer.

$$u^{k-1}_j = \sum_i (x^{k-1}_i * g^{k-1}_{ij})$$

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

an input transducer, which receives an input signal, and an output transducer, said input transducer and said output transducer having a signal path therebetween traversed by said input signal;

amplifier and transmission means connected in said signal path for modifying said input signal, said amplifier and transmission means containing at least one adjustable circuit component which acts on said input signal, and said amplifier and transmission means having a signal tap at which a tapped signal is present;

completely digitally constructed calculating means, disposed outside of said signal path and connected to said signal tap, for generating a control signal dependent on said tapped signal by applying said tapped signal to a neural structure in said calculating means outside of said signal path, and for supplying said control signal to said at least one component in said amplifier and transmission means for modifying said input signal in said input path dependent on said tapped signal; and an analog-to-digital converter connected between said amplifier and transmission means for converting said tapped signal into a digital signal, and a digital-to-analog converter connected between said calculating means and said amplifier and transmission means for converting said control signal into an analog signal.

2. A hearing aid as claimed in claim 1 wherein said amplifier and transmission means includes a memory in which a plurality of different sets of amplification and transmission parameters are stored, and wherein said calculating means comprises means for generating said control signal for selecting one of said parameter sets.

3. A hearing aid as claimed in claim 1 further comprising signal editing means, connected between said signal tap and said calculating means, for editing said tapped signal.

4. A hearing aid as claimed in claim 1 wherein said calculating means comprises a control module, at least one memory, and at least one calculation module, said control module, said at least one memory and said at least one calculation module being interconnected with each other.

5. A hearing aid as claimed in claim 4 wherein said neural structure comprises a plurality of neurons, and wherein said hearing aid comprises a separate calculating module for each neuron.

6. A hearing aid as claimed in claim 4 wherein said neural structure comprises a plurality of neurons, and wherein said hearing aid comprises a separate parameter memory for each neuron.

7. A hearing aid as claimed in claim 4 comprising, for each neuron, a separate calculating module connected to a separate parameter memory.

8. A hearing aid as claimed in claim 4 wherein said neural structure comprises a plurality of neurons, and wherein said hearing aid comprises a separate calculating module for each layer of neurons.

9. A hearing aid as claimed in claim 4 wherein said neural structure comprises a plurality of neurons, and wherein said hearing aid comprises a separate parameter memory for each layer of neurons.

10. A hearing aid as claimed in claim 4 comprising, for each layer of neurons, a separate calculating module connected to a separate parameter memory.

11. A hearing aid as claimed in claim 1 wherein said neural structure comprises a plurality of neuron layers each having a plurality of neurons, and wherein said calculating means comprises a separate calculating module for each of said neuron layers, and at least one intermediate memory providing a connection between neurons in successive neuron layers.

12. A hearing aid as claimed in claim 11 wherein said intermediate memory comprises an intermediate memory with feedback.

13. A hearing aid as claimed in claim 1 further comprising a parameter matching module, connectable to said calculating means, for training said neural structure.

14. A hearing aid as claimed in claim 13 wherein said parameter matching module comprises means for applying training data to said neural structure, means for calculating a portion of output signals of said neural structure using said training data, means for calculating an error at an output of said neural structure arising due to said portion of output signals, and means, if said error exceeds a predetermined limit, for calculating an error arising in an entirety of said neural structure and modifying weighting factors to reduce said error.

15. A hearing aid as claimed in claim 13 wherein said parameter matching module comprises means for matching parameters of said calculating means for approximating a control signal, produced by said calculating means for a given input signal, to a target reply.

16. A hearing aid as claimed in claim 15 wherein said calculating means comprises a plurality of neurons each having a weighting factor associated therewith, and wherein said means for matching parameters in said parameter matching module comprises means for matching said weighting factors.

17. A hearing aid as claimed in claim 15 further comprising auxiliary means for determining a plurality of target replies during an optimization phase for training said neural structure by selecting a target reply respectively for a plurality of different auditory situations, from among a plurality of available target replies, which is optimum for a user of said hearing aid.

* * * * *